US006498914B2

(12) United States Patent
Hashimoto et al.

(10) Patent No.: US 6,498,914 B2
(45) Date of Patent: Dec. 24, 2002

(54) SEAL PART AND DEVELOPING DEVICE HAVING THE SAME

(75) Inventors: Koji Hashimoto, Shizuoka-ken (JP); Kazuhiko Kanno, Odawara (JP); Koji Yamaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/796,456

(22) Filed: Mar. 2, 2001

(65) Prior Publication Data

US 2001/0021318 A1 Sep. 13, 2001

(30) Foreign Application Priority Data

Mar. 9, 2000 (JP) ..... 2000-064414

(51) Int. Cl.[7] ..... G03G 15/08
(52) U.S. Cl. ..... 399/103
(58) Field of Search ..... 399/98, 102, 103, 399/105, 106, 109

(56) References Cited

U.S. PATENT DOCUMENTS 5,166,731 A * 11/1992 Aimoto et al. ..... 399/103
5,475,467 A 12/1995 Watanabe et al.
5,541,710 A * 7/1996 Stewart et al. ..... 399/98
5,655,178 A * 8/1997 Ishikawa et al. ..... 399/102
5,758,230 A * 5/1998 Nakaue et al. ..... 399/103
5,946,530 A * 8/1999 Tsuji et al. ..... 399/103
5,983,053 A * 11/1999 Mordenga et al. ..... 399/103
6,002,898 A 12/1999 Yokomori et al. ..... 399/119
6,104,895 A 8/2000 Yokomori et al. ..... 399/113
6,144,820 A 11/2000 Ishii et al. ..... 399/90
6,192,209 B1 * 2/2001 Ichikawa et al. ..... 399/105
6,215,967 B1 4/2001 Takeda et al. ..... 399/43

FOREIGN PATENT DOCUMENTS

JP 54-043038 4/1979

* cited by examiner

*Primary Examiner*—Sandra Brase
(74) *Attorney, Agent, or Firm*—Fitzpatrick, Cella, Harper & Scinto

(57) ABSTRACT

A bushing used in a developer container to seal a developer, has an aperture portion through which a rotary member extends. The aperture portion is provided with a seal portion contacting with the peripheral surface of the rotary member and preventing the developer from leaking out. A fitting portion fits in a recess formed in a frame of the developer container. The fitting portion is formed integrally with the seal portion.

28 Claims, 10 Drawing Sheets

SEAL PART AND DEVELOPING DEVICE HAVING THE SAME

BACKGROUND OF THE INVENTION

1. Field of the Invention

This invention relates to a seal part for sealing a developer and a developing device having the same. This developing device is preferably used in an image forming apparatus such as an electrophotographic copier or an electrophotographic printer, or a process cartridge detachably attachable to the main body of the image forming apparatus.

The electrophotographic image forming apparatus is an apparatus for forming an image on a recording medium by the use of the electrophotographic image forming method. Examples of the electrophotographic image forming apparatus include, for example, electrophotographic copiers, electrophotographic printers (such as laser beam printers and LED printers), facsimile apparatuses and word processors.

Also, the process cartridge refers to at least one of charging means, developing means and cleaning means and an electrophotographic photosensitive member integrally made into a cartridge which is detachably attachable to the main body of the image forming apparatus.

2. Related Background Art

In the electrophotographic image forming apparatuses using the electrophotographic image forming process, it is known to use a process cartridge system whereby an electrophotographic photosensitive member and process means for acting on the electrophotographic photosensitive member are integrally made into a cartridge detachably attachable to the main body of the image forming apparatus. According to this process cartridge system, the maintenance of the apparatus can be done by a user himself without resorting to a serviceman and therefore, operability could be markedly improved. So, this process cartridge system is widely used in the electrophotographic image forming apparatuses.

Also, the developing cartridge system whereby for example, developing means of the process means except the electrophotographic photosensitive member is integrally made into a cartridge detachably attachable to the main body of the image forming apparatus is adopted in multicolor electrophotographic image forming apparatuses, and has an effect similar to that described above.

In the electrophotographic image forming apparatus of the electrophotographic type (hereinafter referred to as the image forming apparatus), it is practiced to visualize an electrostatic latent image formed on an image bearing member as a toner image by a developing device.

As such a developing device, various dry monocomponent developing devices have been proposed and put into practical use. In any of these developing devices, however, it is difficult to form a thin layer of a toner which is a monocomponent developer on a developer bearing member.

However, now that improvements in the resolving power, definition, etc. of image are required, the development of a method of and an apparatus for forming a thin layer of a toner is requisite, and several measures for this have been proposed.

For example, as disclosed in Japanese Patent Application Laid-Open No. 54-43038, an elastic blade or the like as a regulating member formed of such a material as a metal or rubber is made to abut against a developing sleeve which is a developer bearing member, and a toner is passed through the abutting portion between the elastic blade and the developing sleeve and is regulated, whereby a thin layer of the toner is formed on the developing sleeve and sufficient triboelectricity is imparted to the toner by the friction in the abutting portion.

In this case, when a nonmagnetic toner is to be regulated by the above-described elastic blade, a toner supplying member for supplying the toner onto the developing sleeve becomes discretely necessary. This is because in the case of a magnetic toner, the toner can be supplied onto the developing sleeve by the force of a magnet in the developing sleeve, but in the case of the nonmagnetic toner, the supply of the toner cannot be effected.

As an example, there is a case where a toner supplying roller formed of urethan or the like is used as the toner supplying member. The toner supplying roller comprises a metal shaft and a roller portion of urethane formed thereon, is mounted on a developing container so as to be in contact with the developer bearing member, is supported by bearing members mounted on the opposite ends of the developing container, and is rotated so that the peripheral surface of that portion thereof which is opposed to the direction of movement of the peripheral surface of the developer bearing member may be moved in the opposite direction. The developing container supporting a developing member has its interior and exterior partitioned by a partition member, and the space between the partition member and the developing member is sealed.

A conventional method of mounting the toner supplying roller will now be described with reference to FIG. 11 of the accompanying drawings. In FIG. 11, when mounting a toner supplying roller 9R on a developing container 26, one shaft 9*j*R of the toner supplying roller 9R is passed into an aperture portion 26*a*R formed at one end of a wall portion 26*a* which is a partition member for the interior and exterior of the developing container 26, and the other shaft 9*j*F of the toner supplying roller is put into a cut-away portion 26*a*K formed at the opposite side to the aperture portion 26*a*R of the developing container 26, and the shaft 9*j*F of the toner supplying roller 9R is passed into an aperture portion 25*a* provided in a filling member 25 filling the cut-away portion 26*a*K, and the filling member 25 is attached to the developing container 26 to thereby fill the cut-away portion 26*a*K.

Thereafter, as shown in FIG. 11, shaft seal members 28 formed of felt or the like are fitted onto the shafts 9*j*F and 9*j*R at the opposite ends of the toner supplying roller 9R, and lastly bearing members 27F and 27R are assembled to the shafts from the opposite sides, whereby the toner supplying roller 9R is supported. In this construction, the shaft seal members 28 of felt may sometimes be deformed and therefore, auxiliary shaft seals such as oil seals 29 as auxiliary means for the shaft seal members 28 are assembled to the toner supplying roller shaft supporting portions 27Fj and 27Rj of the bearing members 27F and 27R on the opposite sides.

The relation between the filling member 25 and the toner supplying roller shaft 9*j*F is such that as shown in FIG. 11, the aperture portion 25*a* provided in the filling member 25 and the toner supplying roller shaft 9*j*F are not at all in contact with each other, but have a gap therebetween.

In recent years, however, the main body of the image forming apparatus tends to become lower in cost and smaller in size and along therewith, the necessity of lower cost and smaller size has also increased in the process cartridge.

In the above-described example of the conventional art, however, besides the filling member filling the cut-away portion when the toner supplying roller is incorporated into the developing container, a plurality of seal members such as the shaft seal members and the auxiliary seals for the shaft seals in which the bearing members of the toner supplying roller are provided become necessary and cause an increase in cost and also, provision must be made of spaces for incorporating those seal members therein, and this has hindered the downsizing of the process cartridge.

SUMMARY OF THE INVENTION

The present invention solves the above-noted problem and an object thereof is to provide a method of constructing the seal of a rotary member extending through a partition member at a low cost and with a saved space, and to provide a seal part and a developing device directed to the same purpose.

Another object of the present invention is to provide a seal part and a developing device of which a portion of the frame is formed by the seal part.

DESCRIPTION OF THE PREFERRED EMBODIMENTS

First Embodiment

Figure 1:
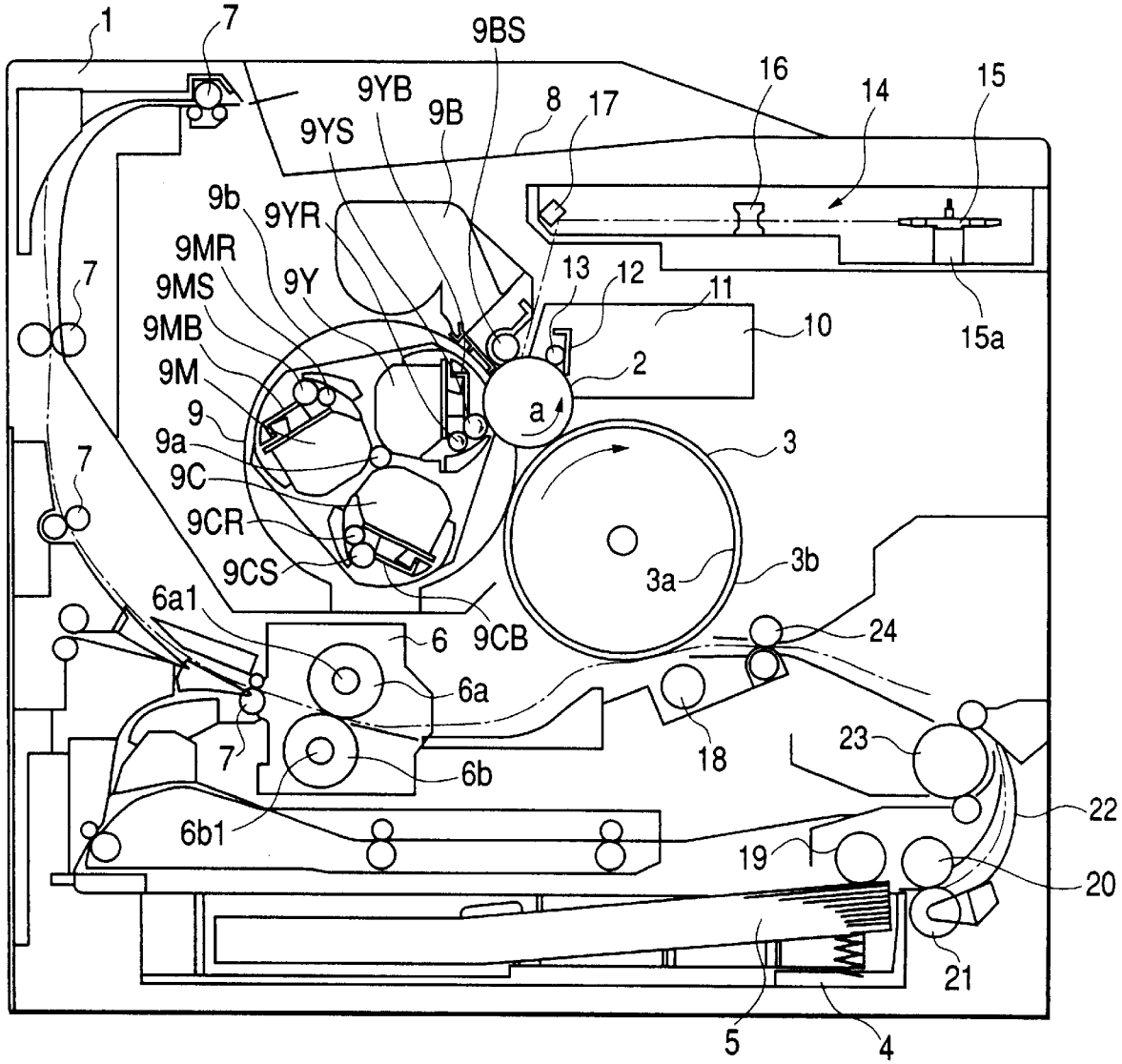
FIG. 1 is a longitudinal cross-sectional view showing the construction of an image forming apparatus using a process cartridge according to the present invention.
Figure 2:
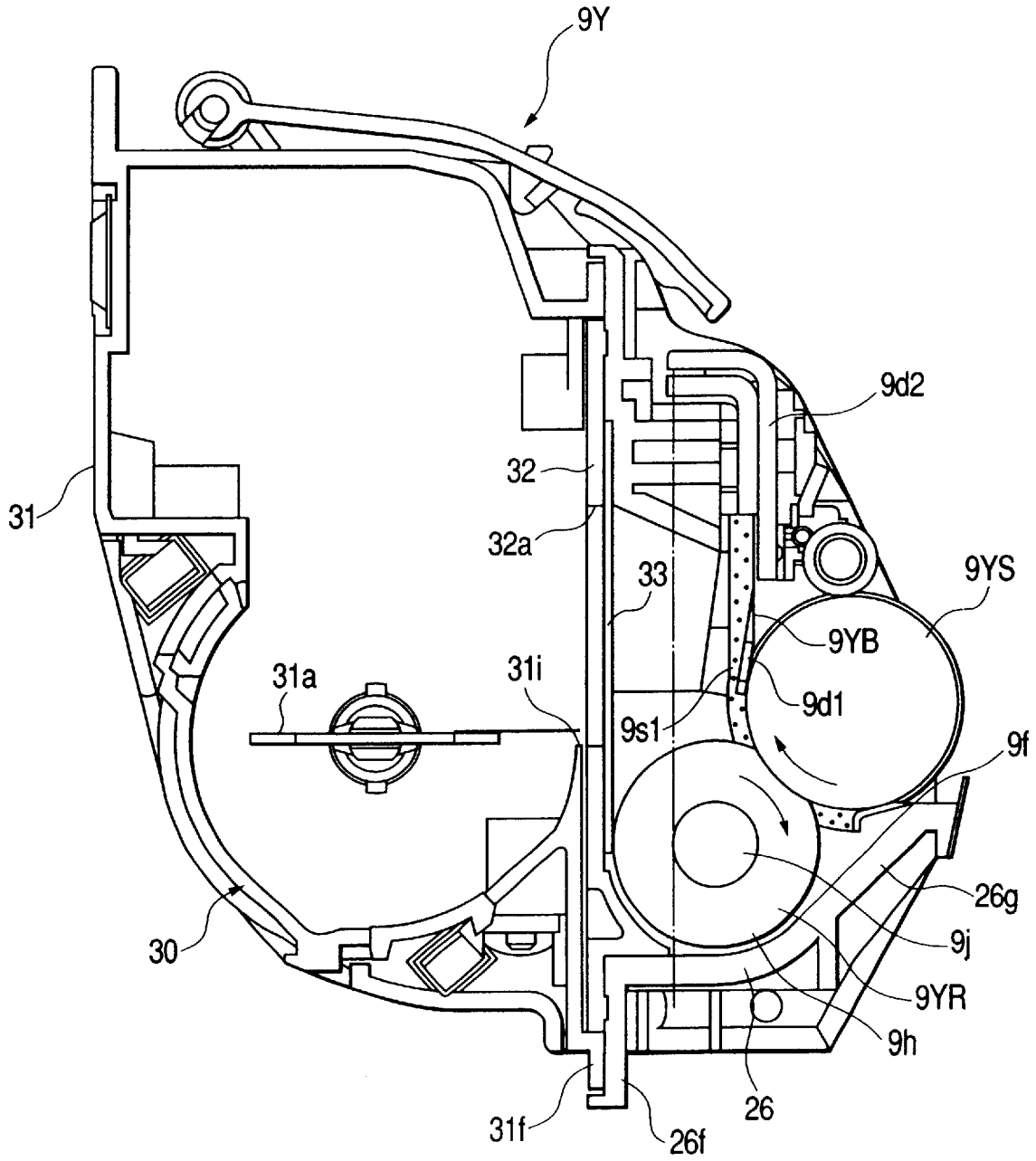
FIG. 2 is a longitudinal cross-sectional view of a developing device used in the image forming apparatus shown in FIG. 1.

A developing device according to the present invention and an embodiment in which the present invention is applied to a color laser beam printer as an example of an image forming apparatus using the same will hereinafter be specifically described with reference to the drawings. FIG. 1 is a cross-sectional illustration showing the construction of an image forming apparatus using a developing cartridge, and FIG. 2 is a cross-sectional illustration showing the relation between a toner supplying roller and a filling member according to the present invention.

General Construction of the Image Forming Apparatus

Reference is first had to FIG. 1 to describe the general construction of the image forming apparatus according to the present invention. In FIG. 1, the image forming apparatus is such that toner images which are developers formed on the surface of a photosensitive drum 2 providing image forming means comprised of an electrophotographic photosensitive member rotated at a constant speed are transferred to an intermediate transfer member 3 a predetermined number of times, whereafter the toner images on the intermediate transfer member 3 are collectively transferred to a transfer material 5 fed from a cassette 4 which is a feeding portion, and the transfer material 5 is conveyed to a fixing device 6, and is discharged to a discharge portion 8 in the upper portion of the main body 1 of the image forming apparatus by discharge rollers 7.

Also, developing means 9 comprising a black developing device 9B fixed to the main body 1 of the image forming apparatus and rotatable color developing devices 9Y, 9M and 9C of three colors (yellow, magenta and cyan) is provided in proximity to the photosensitive drum 2, and electrostatic latent image formed on the photosensitive drum 2 are developed by the developing means 9, and are multilayer transferred onto the intermediate transfer member 3, whereby a color image is formed.

The rotatable color developing devices 9Y, 9M and 9C and the fixed black developing device 9B which are examples of a developer cartridge are made discretely detachably attachable to the main body 1 of the apparatus.

A process cartridge 10 is constructed integrally with the photosensitive drum 2 and a cleaning container 11 serving also as a holder for the photosensitive drum 2 and for collecting any residual substances on the surface of the photosensitive drum 2. This process cartridge 10 is supported detachably by the main body 1 of the apparatus, and is designed to be capable of being easily unit-interchanged in accordance with the life of the photosensitive drum 2.

The photosensitive drum 2 in the present embodiment is comprised of a cylinder made of aluminum and having a diameter of about 62 mm and an organic photoconductive layer applied to the outer side thereof, and is supported for rotation relative to the cleaning container 11 serving also as the holder of the photosensitive drum 2. Near the outer periphery of the photosensitive drum 2, there are disposed a cleaning blade which is cleaning means for removing any residual substance on the surface of the photosensitive drum 2, and primary charging means 13 for charging the surface of the photosensitive drum 2.

Also, the photosensitive drum 2 is rotated in the direction of arrow "a" in FIG. 1 correspondingly to the image forming operation by the driving force of a drive motor, not shown, being transmitted to one end thereof at the inner side in and out of the drawing sheet of FIG. 1.

The primary charging means 13 uses the contact charging method, and the primary charging means 13 which is an electrically conductive roller is brought into contact with the photosensitive drum 2 and a voltage is applied to this primary charging means 13 to thereby uniformly charge the surface of the photosensitive drum 2.

The exposure of the photosensitive drum 2 is effected from a scanner portion 14 disposed in the upper portion of the main body 1 of the apparatus. That is, when an image signal is given to a laser diode, not shown, this laser diode applies an image light corresponding to the image signal to a polygon mirror 15.

This polygon mirror 15 is rotated at a high speed by a scanner motor 15*a*, and the surface of the photosensitive drum 2 being rotated at a constant speed is selectively exposed to the image light reflected by the polygon mirror 15, through an imaging lens 16 and a reflecting mirror 17 and as the result, an electrostatic latent image is formed on the surface of the photosensitive drum 2.

The developing means 9 for visualizing the electrostatic latent image, as previously described, is comprised of three color developing devices 9Y, 9M and 9C and a black developing device 9B capable of developing in yellow, magenta, cyan and black.

The black developing device 9B is a stationary developing device, and a developing sleeve 9BS which is a developing rotary member for supplying the photosensitive drum 2 with a black toner which is a developer is disposed at a location opposed to the photosensitive drum 2 with a minute spacing (of the order of 300 $\mu$m) with respect to the photosensitive drum 2, and forms a visible image by the black toner correspondingly to the electrostatic latent image on the photosensitive drum 2.

On the other hand, each of the three color developing devices 9Y, 9M and 9C contains therein a toner corresponding to 7,000 pages (A4 size 5% coverage rate) and is detachably supported by a developing rotary 9*b* rotated about a shaft 9*a*.

During image formation, the respective color developing devices 9Y, 9M and 9C are rotatively moved about the shaft 9*a* while being supported by the developing rotary 9*b*, and a predetermined one of the color developing devices 9Y, 9M and 9C is stopped at a location opposed to the photosensitive drum 2, and sleeves 9YS, 9MS and 9CS which are developing rotary members for supplying the photosensitive drum 2 with yellow, magenta and cyan toners which are nonmagnetic monocomponent developers are positioned so as to be opposed to the photosensitive drum 2 with a minute spacing (of the order of 300 $\mu$m) therebetween, whereafter they form visible images by the color toners correspondingly to the electrostatic latent image on the photosensitive drum 2.

During color image formation, the developing rotary 9*b* is rotated for each one full rotation of the intermediate transfer member 3, and the developing steps are executed in the order of the yellow developing device 9Y, the magenta developing device 9M, the cyan developing device 9C and the black developing device 9B.

FIG. 1 shows a state in which the yellow developing device 9Y is positioned in opposed relationship with the photosensitive drum 2 and is stationary. The yellow developing device 9Y feeds the toner in a developing container for containing the developer therein to a toner supplying roller 9YR which is a supplying rotary member for supplying the toner to the surface of the developing sleeve 9YS by a feeding mechanism, and applies a thin layer of toner to the surface of the developing sleeve 9YS being rotated in a clockwise direction as viewed in FIG. 1, by a developing blade 9YB brought into pressure contact with the outer peripheries of the toner supplying roller 9YR and the developing sleeve 9YS being rotated in a clockwise direction as viewed in FIG. 1, and also imparts charges to the toner (frictional charging). Then it applies a developing bias to the developing sleeve 9YS opposed to the photosensitive drum 2 on which the latent image is formed to thereby effect toner development on the photosensitive drum 2 in conformity with the latent image.

With regard also to the magenta developing device 9M and the cyan developing device 9C, toner supplying rollers 9MR and 9CR which are supplying rotary members, developing sleeves 9MS and 9CS which are developing rotary members and developing blades 9MB and 9CB act by a mechanism similar to that described above, whereby the toner developing steps are executed.

Also, the developing sleeves 9YS, 9MS and 9CS of the respective rotary developing devices 9Y, 9M and 9C are connected to high voltage sources for respective color development and driving means provided in the main body 1 of the apparatus when the respective developing devices 9Y, 9M and 9C are driven to be rotated to the developing position, and voltages are successively and selectively applied for respective color development and rotative driving is effected.

During the color image forming operation, the intermediate transfer member 3 is rotated in the clockwise direction as viewed in FIG. 1 in synchronism with the peripheral speed of the photosensitive drum 2 to receive the multilayer transfer of the toner images on the photosensitive drum 2 visualized by the developing devices 9Y, 9M, 9C and 9B four times (the four yellow, magenta, cyan and black images), and the intermediate transfer member 3 which has received the multilayer transfer 3 nips and conveys the transfer material 5 between it and a transfer roller 18 to which a voltage has been applied, whereby the color toner images on the intermediate transfer member 3 are collectively multilayer-transferred to the transfer material 5.

The intermediate transfer member 3 in the present embodiment is of a construction in which the outer periphery of a cylinder 3*a* made of aluminum and having a diameter of 186 mm is covered with an elastic layer 3*b* of medium-resistance sponge, medium-resistance rubber or the like. This intermediate transfer member 3 is rotatably supported and is driven and rotated by a gear, not shown, fixed integrally therewith.

The cleaning means for the photosensitive drum 2 is for removing the toners remaining on the photosensitive drum 2 after the toner images visualized on the photosensitive drum 2 by the developing devices 9Y, 9M, 9C and 9B have been transferred to the intermediate transfer member 3, and the removed toners are collected into the cleaning container 11. The amount of the removed toners collected in the cleaning container 11 does not fill the cleaning container 11 earlier than the end of the life of the photosensitive drum 2 and accordingly, the cleaning container 11 is interchanged simultaneously with the interchange of the photosensitive drum 2.

The feeding portion is for feeding the transfer material 5 to the image forming portion and has a cassette 4 containing a plurality of transfer materials 5 therein, a pickup roller 19, a feed roller 20, a retard roller 21 for preventing double feed, a feed guide 22 and conveying means such as a conveying roller 23 and registration rollers 24.

During image formation, the pickup roller 19 is rotatively driven in conformity with the image forming operation to thereby pay away the transfer materials 5 in the cassette 4, and the transfer materials 5 are separated and fed one by one by the cooperation between the feed roller 20 and the retard roller 21 and the thus fed transfer material 5 is guided by the feed guide 22 and comes to the registration rollers 24 via the conveying roller 23. During the image forming operation, the registration roller 24 performs the nonrotating operation making the transfer material 5 wait stationarily and the rotating operation of conveying the transfer material 5 toward the intermediate transfer member 3 at a predetermined sequence, and provides proper registry between the image and the transfer material 5 during the transferring step which is the next step.

The transferring portion comprises the pivotally movable transfer roller 18 which is comprised of a metallic shaft and a medium-resistance foam elastic member wound on the outer periphery thereof, and is movable in a vertical direction as viewed in FIG. 1 and is rotatively driven.

During the time when four color toner images are formed on the intermediate transfer member 3, that is, during the time when the intermediate transfer member 3 is rotated a plurality of times, the transfer roller 18 is downwardly retracted and spaced apart from the intermediate transfer member 3 so as not to distort those images, and after the four color toner images have been formed on the intermediate transfer member 3, the transfer roller 18 is urged against the intermediate transfer member 3 with predetermined pressure with the transfer material 5 therebetween by a cam, not shown, in accordance with the timing at which the color images are transferred to the transfer material 5. At the same time, a bias is applied to the transfer roller 18, and the toner images formed on the intermediate transfer member 3 are transferred to the transfer material 5.

The intermediate transfer member 3 and the transfer roller 18 are driven independently of each other and therefore, the transfer material 5 nipped between the two is conveyed leftwardly as viewed in FIG. 1 at a predetermined speed and is fed toward the fixing device 6 which is the next step as soon as the transferring step is executed.

The fixing device 6 is for fixing the toner images formed by the developing devices 9Y, 9M, 9C and 9B and transferred onto the transfer material 5 through the intermediate transfer member 3, and comprises a fixing roller 6*a* for applying heat to the transfer material 5, and a pressure roller 6*b* for bringing the transfer material 5 into pressure contact with the fixing roller 6*a*, and the respective rollers 6*a* and 6*b* are hollow rollers having heaters 6*a*1 and 6*b*1, respectively, therein, and the transfer material 5 is nipped between and conveyed by the fixing roller 6*a* and the pressure roller 6*b* and has heat and pressure applied thereto, whereby the toner images are fixed on the transfer material 5.

Sealing Means for the Developing Devices

Figure 6:
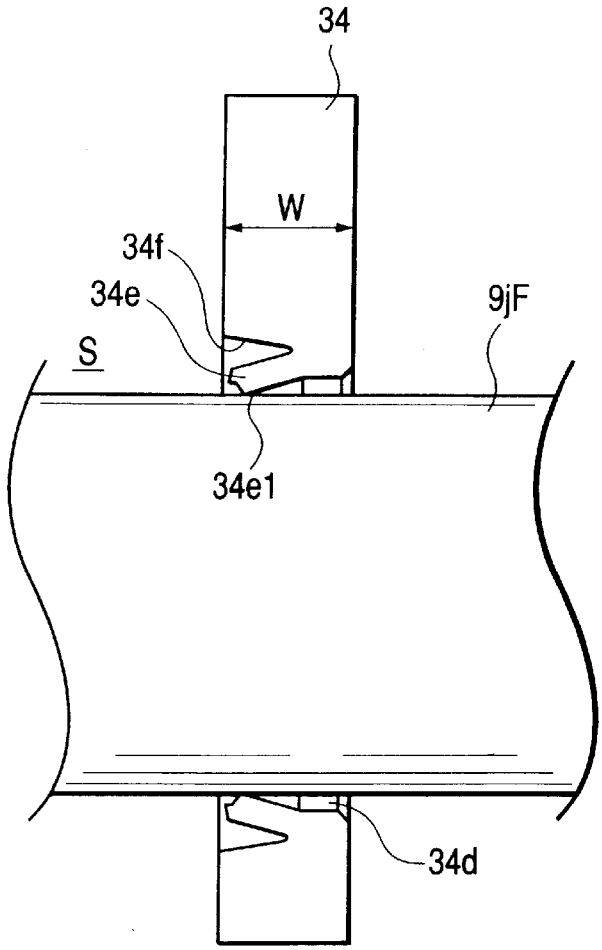
FIG. 6 is a longitudinal sectional view showing the relation between a filling member according to the present invention and the shaft of the roller.
Figure 7:
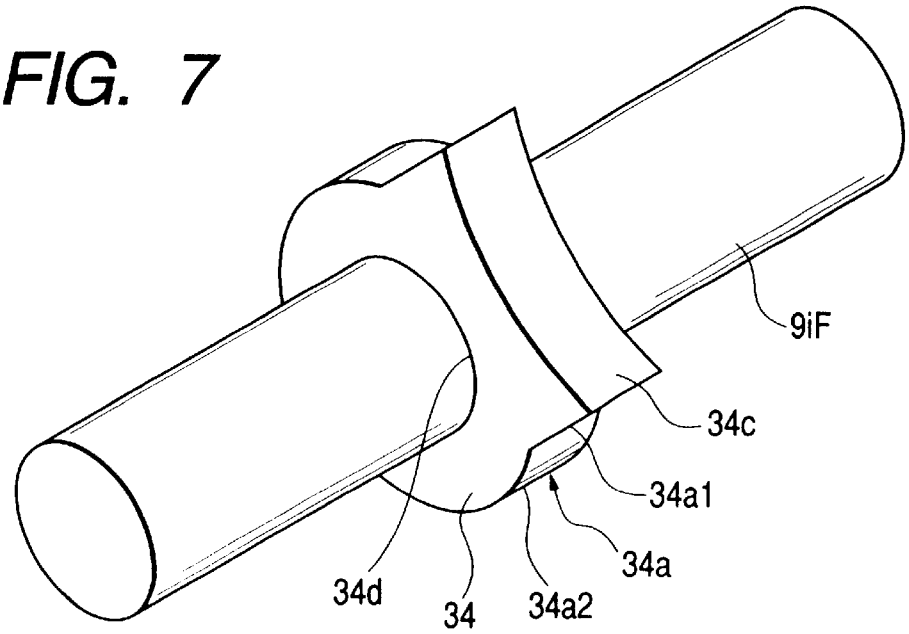
FIG. 7 is a perspective view showing the shaft of the roller and the filling member.

A filling member which is the seal part of the present invention will now be described with reference to FIGS. 6 and 7. The filling member 34 is formed with an aperture 34*d* through which the shaft 9*j*F of the toner supplying roller 9YR is passed. A lip 34*e* is provided on the aperture 34*d* portion by integral forming with the filling member 34 as a partition member, and this lip 34*e* contacts with the toner supplying roller shaft 9*j*F to thereby effect shaft sealing. The filling member 34 is firmly positioned by the developing container 26 and therefore there is no possibility of it being deformed. Consequently, there is no reduction in the shaft sealing performance by deformation or the like and therefore, it is not necessary to provide an auxiliary seal. Also, the shaft seal is provided integrally with the filling member and therefore, any space for newly providing a shaft seal therein is not required, and consequently shaft sealing can be accomplished with the space saved.

While a shaft sealing method has been shown by the lip as an example, use may be made of other sealing method such as the sealing by area contact. The area contact refers to an increased contact width of the lip, and may be, for example, the contact width of the lip approximate to the width W of the filling member 34. Also, when the area contact is used, a groove may be circumferentially formed in the aperture, or a groove may be spirally formed in the aperture. This spiral groove may be formed in a direction in which the action of pushing the toner back into the container by the rotation of the shaft works.

Also, while in the present embodiment, description has been made of the toner supplying roller, the present invention can be carried out in any rotary member, for example, any roller member having shafts at the opposite ends thereof.

The filling member 34 will further be described in detail.

The yellow developing device 9Y shown in FIG. 2 and the magenta developing device 9M and the cyan developing device 9C which are not shown in detail are of the same construction. These color developing devices 9Y, 9M and 9C have toner supplying rollers 9YR, 9MR and 9CR, respectively, having peripheral surfaces moved in the opposite direction to the peripheral surfaces of developing sleeves 9YS, 9MS and 9CS and rotatable in a developing container 26 supporting the developing member of a cartridge frame 30.

In such color developing devices 9Y, 9M and 9C, the toners fed from a toner container 31 to the developing container 26 by the rotation of a toner feeding member 31*a* are applied to the developing sleeves 9YS, 9MS and 9CS by the toner supplying rollers 9YR, 9MR and 9CR, and the toners on the developing sleeves 9YS, 9MS and 9CS are fed out with their layer thicknesses regulated by developing blades 9YB, 9MB and 9CB and develop the electrostatic latent image on the photosensitive drum 2.

A description will hereinafter be made with the color developing devices 9Y, 9M and 9C being typified by the yellow developing device 9Y. The cartridge frame 30 comprises the developing container 26 and the toner container 31 welded together. This welding is such that the flanges 26*f* and 31*f* of the respective containers 26 and 31 abut against each other and are ultrasonic-welded together. The rotatable toner feeding member 31*a* is provided in the toner container 31. The toner feeding member 31*a* is rotatably supported in the toner container 31 so as to feed the toner in the toner container 31 into the developing container 26 through a toner supply opening 31*i* and an opening 32*a*. The opening 32*a* is formed in a cover film plate 32. The cover film plate 32 is welded to the flange 31*f* of the toner container 31. The openings 31*i* and 32*a* are openings somewhat shorter in the lengthwise direction thereof (the axial direction of the developing sleeve 9YS) than the length of the developing sleeve 9YS. A separable or tearable toner seal 33 is stuck on the cover film plate 32 around the opening 32*a* in the cover film plate 32 and seals the opening 32*a*. The toner seal 33 is turned back at lengthwise one end side of its portion sealing the opening 32*a* and is superposed on the toner seal 33 in the sealing portion thereof, and the end portion thereof is drawn out to the exterior of the developing device 9Y. This toner seal 33 can be separated or torn from around the opening 32*a* by pulling its portion drawn out to the exterior prior to the use of the developing device 9Y to thereby unseal the opening 32*a* and enable the toner in the toner container 31 to be fed into the developing container 26 through the openings 31*i* and 32*a*.

This developing device 9Y is detachably attachable to the developing rotary 9*b*. This detachable attachment is effected with the developing device 9Y moved in the lengthwise direction from the axis direction of the developing rotary 9*b* to guide means, not shown, provided on the developing rotary 9*b*. Alternatively, or it is effected with the developing rotary 9*b* put in or out radially thereof and the developing device 9Y rotated while being inserted in the developing rotary 9*b* (these need not be described in detail). That is, the developing devices 9M and 9C are similar to the developing device 9Y and both of them are constructed as developing cartridges. These developing cartridges 9Y, 9M and 9C are interchanged when the toners therein become null.

A description will now be made of sealing means for sealing the leakage of the toner from the developing device 9Y to the exterior thereof when the toner seal 33 has been unsealed.

The developing blade 9YB is an elastic blade 9*d*1 fixed to a blade metal plate 9*d*2, and the elastic blade 9*d*1 is in contact with the generatrix of the developing sleeve 9YS along the developing area thereof by elasticity. Also, a blow-out preventing seal 9*f* stuck on the jaw portion 26*g* of the developing container 26 is stuck over the developing area in the lengthwise direction of the jaw portion 26*g*. The blow-out preventing seal 9*f* in the widthwise direction thereof has a free end toward the interior of the developing container 26, and the portion thereof near the edge of the tip end thereof is in contact with the generatrix of the developing sleeve 9YS by elasticity. Also, seal members 9*s*1 elongate in widthwise direction are provided in proximity with the elastic blade 9*d*1 at the lenthwisely opposite ends of the developing blade 9YB. These seal members 9*s*1 are in contact with the developing sleeve 9YB while describing arcs in the circumferential direction thereof. These seal members 9*s*1 are stuck on the developing container 26. Although not shown in FIG. 2, the portion between the seal members 9*s*1 at the opposite ends is stuck on the developing container 26 and a seal member made of sponge and elongate in the lengthwise direction thereof is provided and is in contact with the interior side of the developing blade 9YB.

For example, urethane rubber is used as the aforedescribed elastic blade 9*d*1, an elastic sheet such as polyethylene terephthalate (PET) is used as the blow-out preventing seal 9*f*, felt is used as the seal members 9*s*1, and sponge is used as the aforedescribed seal member connecting the seal members 9*s*1 together in the lengthwise direction thereof.

The inner corners of the aforedescribed elastic blade 9*d*1 and the arcuate portions of the blow-out preventing seal 9*f* and the seal members 9*s*1 which are adjacent to the developing area side pressurize the elastic blade 9*d*1 and the blow-out preventing seal 9*f* toward the developing sleeve 9YS by a backup material (e.g. a sponge chip) not shown to thereby ensure close seal.

Thus, the toner is sealed so as not to leak to around the developing sleeve.

Now, the elastic blade 9*d*1 of the developing blade 9YB as a regulating member formed of a material such as a metal or rubber is made to abut against the developing sleeve 9YS, and the toner is passed through the contact portion between this elastic blade 9*d*1 and the developing sleeve 9YS and is regulated, whereby a thin layer of the toner is formed on the developing sleeve 9*d*1 and sufficient triboelectricity is imparted to the toner by the friction in the contact portion.

In this case, when as in the present embodiment, the nonmagnetic toner is regulated by the elastic blade 9*d*1, a toner supplying member for supplying the toner onto the developing sleeve 9YS becomes discretely necessary. The reason for this is that in the case of the nonmagnetic toner, the supply of the toner cannot be effected by magnetism.

So, the toner supplying roller 9YR formed of urethane or the like is used as the toner supplying member. The toner supplying roller 9YR has a roller portion 9*h* of urethane formed on a metallic shaft 9*j* (the shaft ends 9*j*F and 9*j*R thereof), and as shown in FIG. 2, is mounted in the developing container 26 so as to contact with the developing sleeve 9YS, and is supported by bearing members 27F and 27R (see FIGS. 4 and 8) mounted on the opposite ends of the developing container 26. The toner supplying roller 9YR is rotated so that in the portion thereof opposed to the developing sleeve 9YS, the direction of movement of the peripheral surface may be opposite to the direction of movement of the peripheral surface of the developing sleeve 9YS.

The toner in the developing container 26 must be sealed so as not to leak to the outside. The wall portion of the developing container 26 is a partition member and the toner supplying roller 9YR cannot receive shaft support and a driving force unless it extends through this wall portion. So, in assembly, the above-mentioned partition member divides the container wall and the partition member is incorporated into the wall portion of the developing container 26 as a portion of the wall portion.

Figure 3:
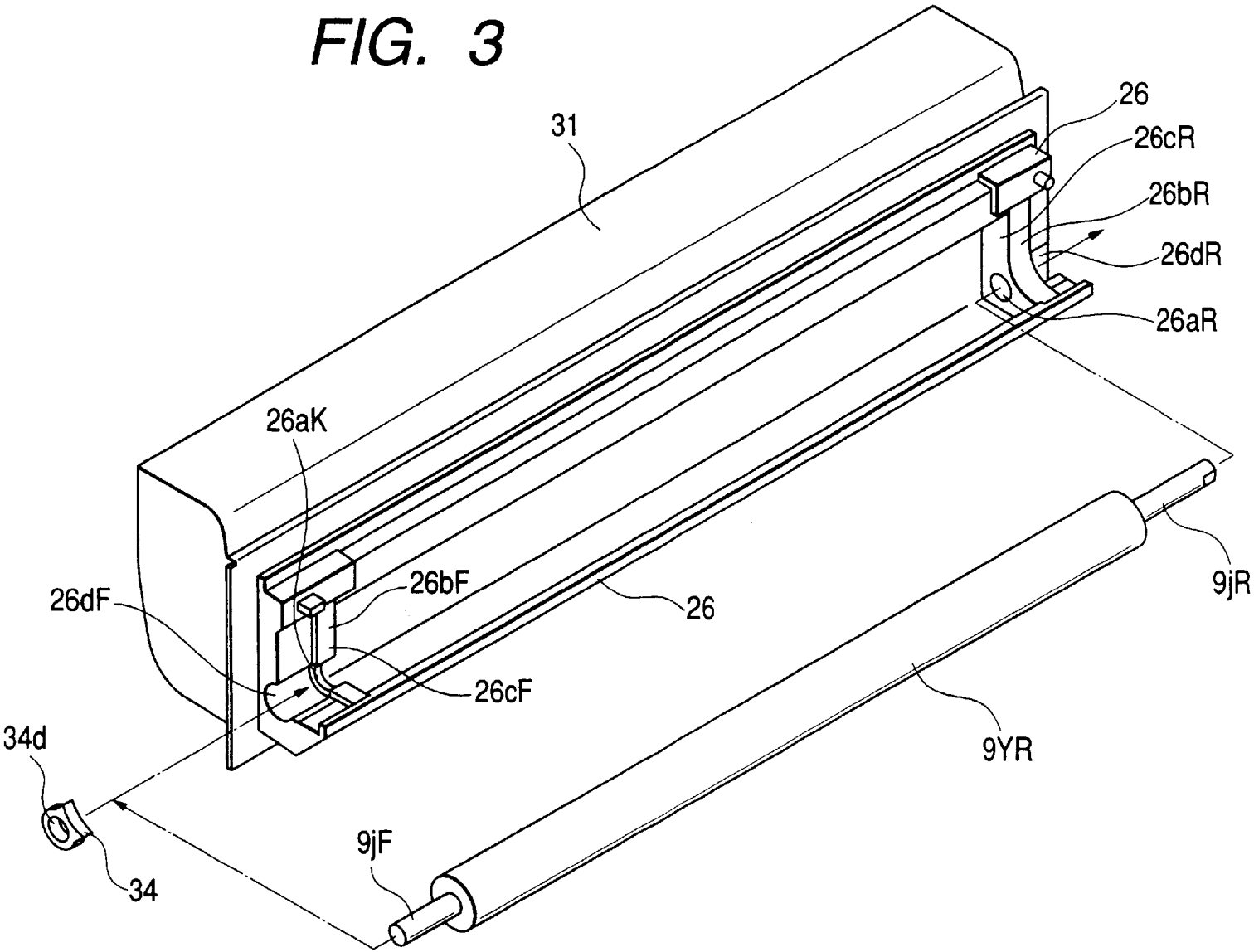
FIG. 3 is a perspective view showing the assembly of a toner supplying roller.

As already described, the developing sleeve 9YS and the developing blade 9YB have the spaces between their lengthwisely opposite sides and the developing container 26 sealed in the widthwise direction by the seal members 9*s*1. As shown in FIG. 3, the shafts 9*j*F and 9*j*R of the toner supplying roller 9YR extend through end walls 26*c*F and 26*c*R, respectively, having seal sticking surfaces 26*b*F and 26*b*R on which the seal members 9*s*1 are stuck. So, the sealing of the toner supplying roller 9YR, if effected by these end walls 26*c*F and 26*c*R, will be effective.

From the viewpoint of assembly, a cut-away portion 26*a*K is provided in the end wall 26*c*F, and an aperture portion 26*a*R is provided in the end wall 26*c*R.

Figure 5:
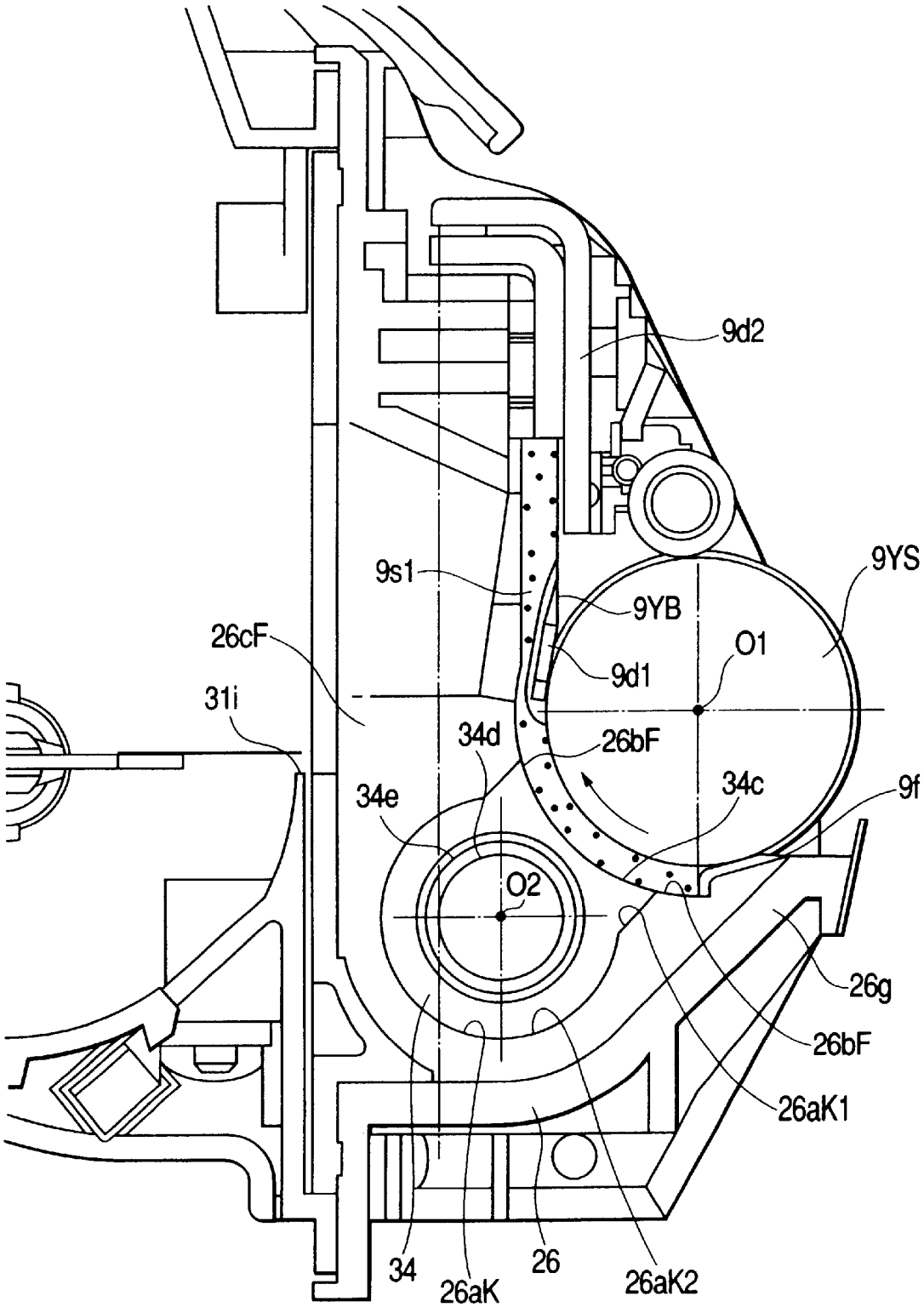
FIG. 5 is a longitudinal cross-sectional view showing the shaft sealing portion of the toner supplying roller.

As shown in FIG. 5, the cut-away portion 26*a*K has a line passing through the centers O1 and O2 of the developing sleeve 9YS and the toner supplying roller 9YR, respectively, as the center line of symmetry. The cut-away portion 26*a*K cut from the seal sticking surface 26*b*F into the end wall 26*c*F has a mouth portion 26*a*K1 forming a plane parallel surface and an incomplete circular portion 26*a*K2 centering about the center O2 of the toner supplying roller 9YR. The distance between the opposed surfaces of the mouth portion 26*a*K1 which is a second recess is smaller than the diameter of the incomplete circular portion 26*a*K2 which is a first recess.

As shown in FIG. 3, a bearing house 26*d*F at the lengthwisely outer side of the end wall 26*c*F is retracted from the seal sticking surface 26*b*F and the cut-away portion 26*a*K, and is substantially similar to the seal sticking surface 26*b*F and the incomplete circular portion 26*a*K2 of the cut-away portion 26*a*K.

Also, a bearing house 26*d*R of which the cross-section at right angle with respect to the center line of the toner supplying roller 9YR is similar to that of the bearing house 26*d*F is provided on the lengthwisely outer side of the end wall 26*c*R provided with the aperture portion 26*a*R.

The filling member 34 is fitted to the cut-away portion 26*a*K provided as a recess in the developing container (developing frame) 26. As shown in FIG. 7, the filling member 34 has a cylinder portion 34*a*2 of which the outer periphery just fits to the incomplete circular portion 26*a*K2 of the cut-away portion 26*a*K, and a fitting portion 34*a* having a two-surface widthwise portion 34*a*1 just fitting to the mouth portion 26*a*K1. The outer side of the two-surface widthwise portion 34*a*1 has a seal sticking surface 34*c* which is an arc centered on the center O1 of the developing sleeve 9YS and which is equal in diameter to the seal sticking surface 26*b*F and smoothly continues from it. The aforementioned seal members 9*s*1 are continuously stuck on the seal sticking surfaces 26*b*F and 34*c*.

An aperture 34*d* is formed at the center of the filling member 34. This aperture 34*d* is one through which the shaft 9*j*F of the toner supplying roller 9YR is sealed and extends.

As shown in FIG. 5, the aperture 34*d* is a circle centered on the center of the incomplete circular portion 26*a*K2 of the cut-away portion 26*a*K which is the recess of the filling member 34, i.e., the center O2 of the toner supplying roller 9YR. As shown in FIG. 6, this aperture 34*d* is one in which the lip 34*e* is integrally molded from the base material of the filling member 34. The lip 34*e* is generally a hollow truncated cone, and the proximal end of the lip 34*e* is connected to an aperture 34*f* larger than the shaft 9*j*F of the toner supplying roller 9YR which is a rotary member. This lip 34*e* is within the width W of the filling member 34. The aperture 34*f* is a portion of a cone reduced in diameter from the filling member 34 toward the side on which the toner is present. That is, the lip 34*e* has its distal end 34*e*1 extending from the proximal end toward a space S in which the toner to be sealed is present. The inner diameter of the distal end 34*e*1 of this lip is smaller than the diameter of the shaft 9*j*F in a state in which the shaft 9*i*F of the toner supplying roller 9YR does not extend through the filling member, and when as shown in FIG. 6, the shaft 9*j*F extends through the filling member, the distal end 34*e*1 of the lip has its diameter enlarged against the elasticity of the lip 34*e*.

The filling member 34 is disposed as described above and therefore, even if the pressure of the toner in the developing device 26 is transmitted to the sealed shaft portion, it is transmitted to a space having a wedge-shaped cross-section between the aperture 34*f* and the lip 34*e* and thus, the pressurizing force of the lip 34*e* against the shaft 9*j*F is heightened to thereby ensure close sealing.

The material of the filling member 34 is rubber or synthetic resin. These are selected so as to suitably select the elasticity of the lip 34*e*.

Figure 8:
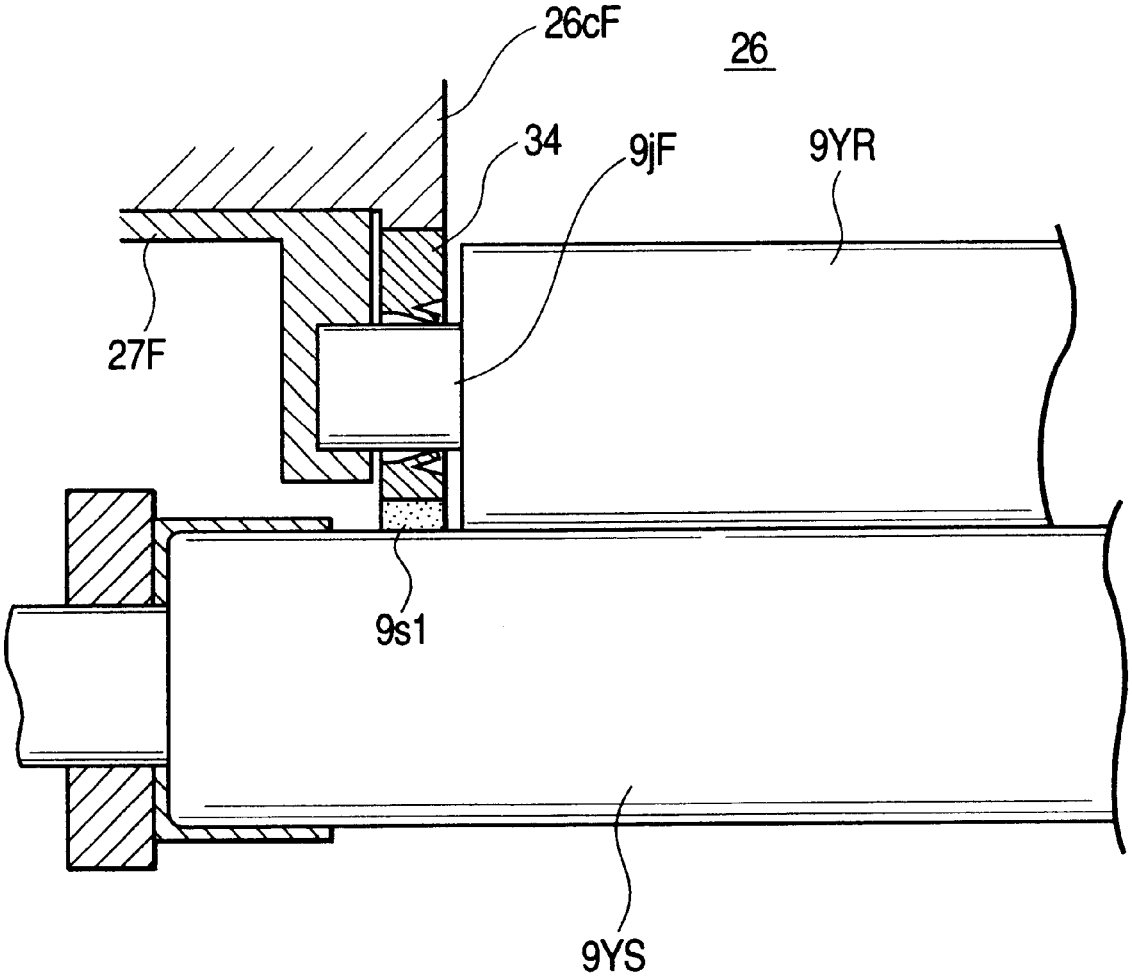
FIG. 8 is a longitudinal cross-sectional view along the axis of the toner supplying roller.

With such a construction, the shaft sealing means of the toner supplying roller 9YR is within the width of the filling member 34. So, as shown in FIG. 8, a bearing member 27F supporting the shaft 9*j*F of the toner supplying roller 9YR can be brought close to the end wall 26*c*F of the developing container 26. So, the length of the developing device 9Y in the longitudinal direction thereof can be made small.

A method of mounting the toner supplying roller 9YR will now be described. When the toner supplying roller 9YR is to be mounted on the developing container 26, as shown in FIG. 3, one shaft 9*j*R of the toner supplying roller 9YR is passed through an aperture portion 26*a*R at one end of the developing container 26 and the other shaft 9*j*F of the toner supplying roller 9YR is put into the cut-away portion 26*a*K at the opposite side to this aperture portion 26*a*R of the developing device 26, and the shaft 9*j*F of the toner supply roller 9YR is passed through the aperture 34*d* formed in the filling member 34 for filling the cut-away portion 26*a*K and the filling member 34 is mounted on the developing container 26 to thereby fill the cut-away portion 26*a*K.

Figure 4:
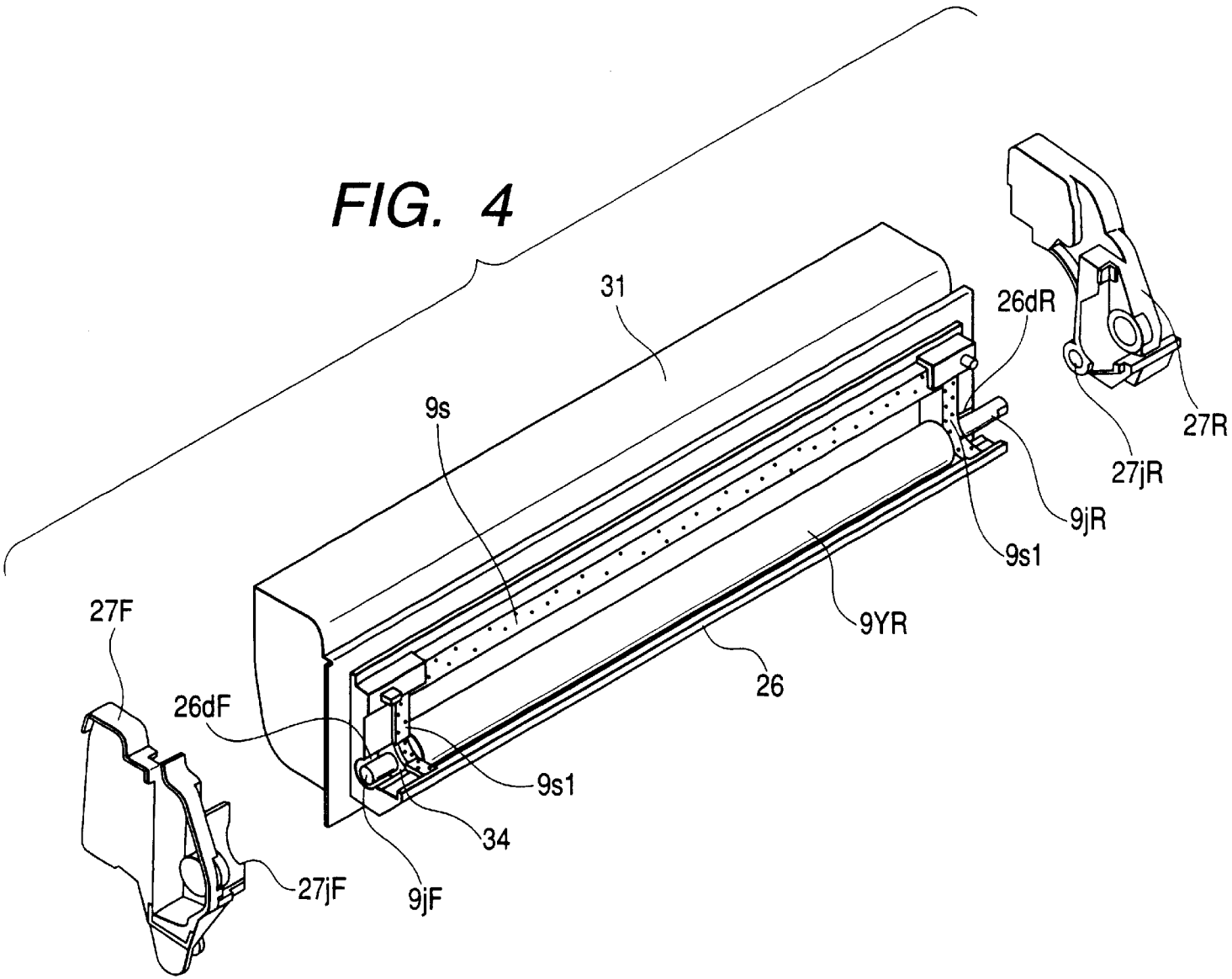
FIG. 4 is a perspective view showing the assembly of the toner supplying roller.

Thereafter, as shown in FIG. 4, the bearing members 27F and 27R are assembled to the bearing houses 26*d*F and 26*d*R, respectively, at the opposite ends of the toner supplying roller 9YR and the bearing members 27F and 27R are fixed to the developing container 26, whereby the toner supplying roller 9YR is supported.

In case of this assembling, the outer peripheries of hollow cylindrical shaft supporting portions 27*j*F and 27*j*R provided on the bearing members 27F and 27R, respectively, just fit to the bearing houses 26*d*F and 26*d*R of the developing container 26. The bores of shaft supporting portions 27*j*F and 27*j*R slidably fit onto the shaft 9*j*F and 9*j*R, respectively, of the toner supplying roller 9YR.

While in the foregoing, the shaft sealing of the shaft 9*j*F side at one end has been described, a similar construction may also be adopted at the shaft 9*j*R side at the other end. Further, for the shaft sealing of the shaft 9*j*R, the lip contacting with the shaft 9*j*R may be molded integrally with the end wall 26*c*R, i.e., the developing container 26, on the inner periphery of the aperture portion 26*a*R of the end wall 26*c*R.

Second Embodiment

Figure 9:
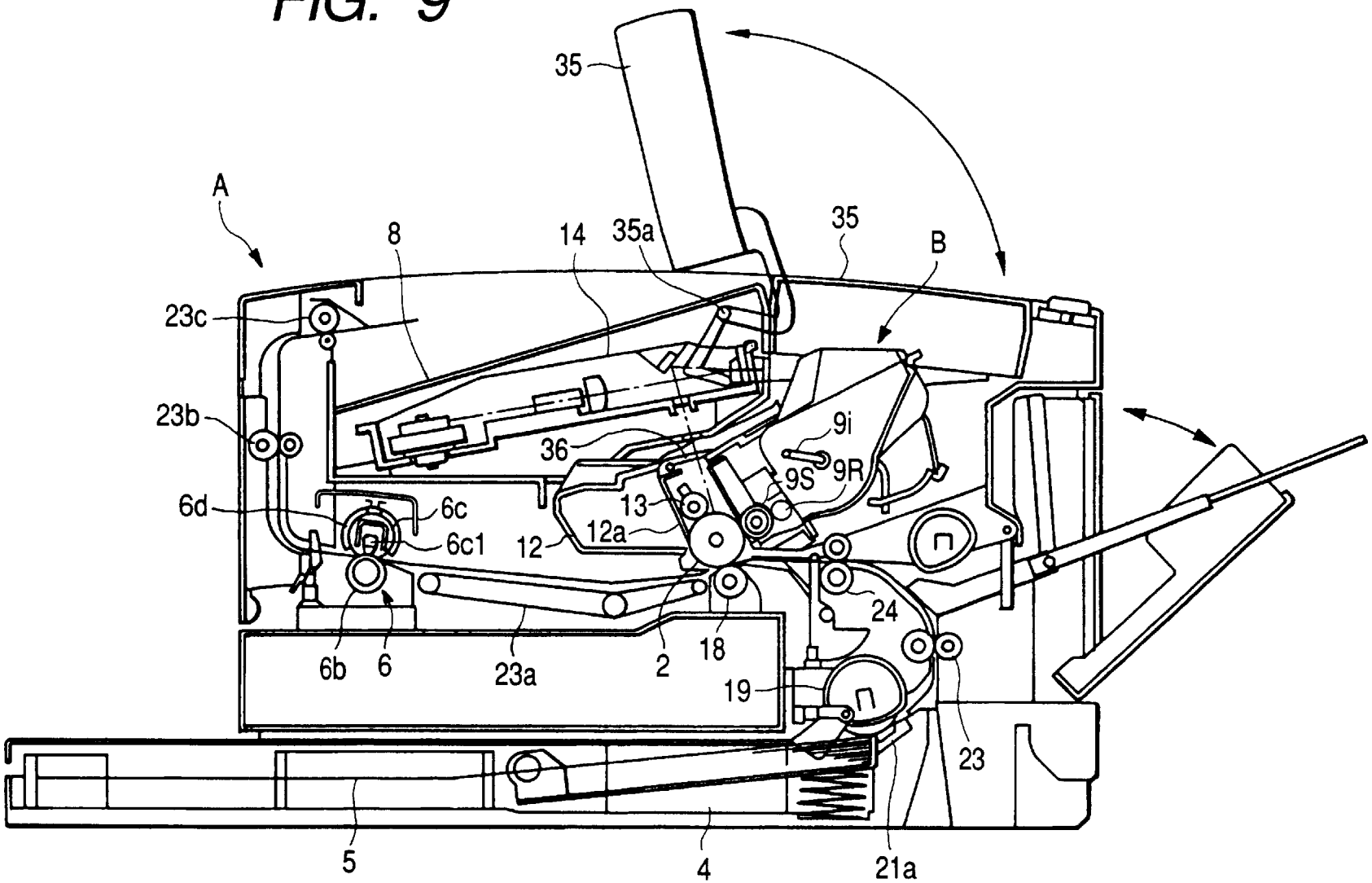
FIG. 9 is a longitudinal cross-sectional view of an electrophotographic image forming apparatus in which a process cartridge is used.
Figure 10:
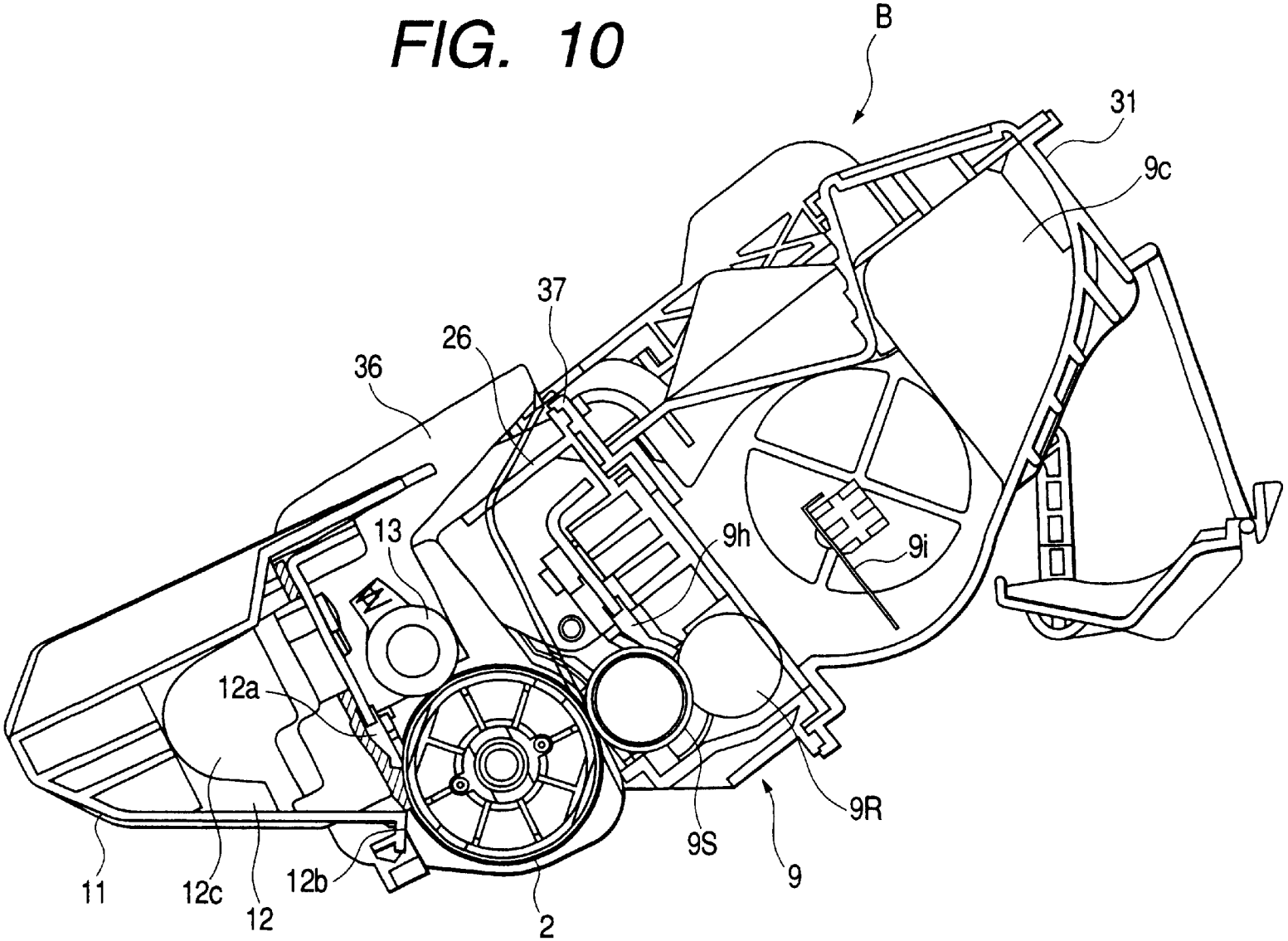
FIG. 10 is a longitudinal cross-sectional view of the process cartridge.
Figure 11:
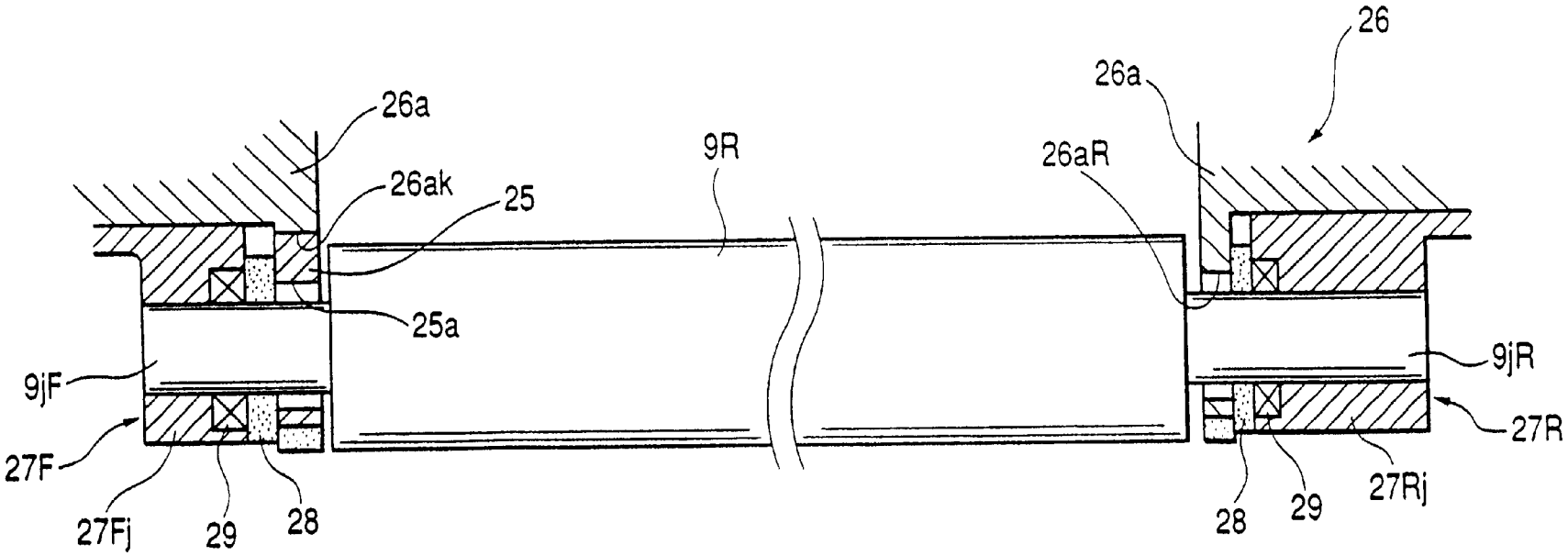
FIG. 11 PRIOR ART
FIG. 11 is a longitudinal cross-sectional view showing the relation between a filling member and the shaft of a roller in the conventional art.

This embodiment is applied to a process cartridge using a monochromatic nonmagnetic powder developer. FIG. 9 is a longitudinal cross-sectional view of an image forming apparatus, and FIG. 10 is a longitudinal cross-sectional view of the process cartridge.

General Construction of the Image Forming Apparatus

This electrophotographic image forming apparatus (laser beam printer) A, as shown in FIG. 9, applies an information light based on image information from a scanner portion 14 to a drum-shaped electrophotographic photosensitive member 2 to thereby form a latent image on this photosensitive member 2, and develops this latent image to thereby form a toner image. In synchronism with the formation of the toner image, transfer materials 5 which are recording mediums are separated and fed one by one from a feed cassette 4 by a pickup roller 19 and a pressure contact member 21*a* pressure-contacting therewith and are conveyed by conveying means comprising a pair of conveying rollers 23, registration rollers 24, etc., and the toner image formed on the electrophotographic photosensitive member made into a process cartridge B is transferred to the transfer material 5 by a voltage being applied to a transfer roller 18 as transferring means, and the transfer material 5 is conveyed to a fixing device 6 by a conveying belt 23*a*. This fixing device 6 comprises a pressure roller 6*b* and a fixing rotary member 6*d* comprised of a cylindrical sheet containing a heater 6*c*1 therein and rotatably supported by a supporting member 6*c*, and applies heat and pressure to the transfer material 5 passing there to thereby fix the transferred toner image. This transfer material 5 may be conveyed by a pair of discharge rollers 23*b* and 23*c*, and be discharged to a discharge portion 8 through a surface reverse conveying path.

On the other hand, the process cartridge B is provided with an electrophotographic photosensitive member and at least one process means. The process means include, for example, charging means for charging the electrophotographic photosensitive member, developing means for developing a latent image formed on the electrophotographic photosensitive member, cleaning means for removing any toner residual on the surface of the electrophotographic photosensitive member, etc. The process cartridge B in the present embodiment, as shown in FIG. 10, is designed such that an electrophotographic photosensitive drum 2 which is a drum-shaped electrophotographic photosensitive member having a photoconductive layer is rotated and a voltage is applied to roller-shaped primary charging means 13 to thereby uniformly charge the surface of the photosensitive drum 2, and this charged photosensitive drum 2 is exposed to an optical image from the scanner portion 14 through an opening portion 36 to thereby form an electrostatic latent image, and this latent image is developed by developing means 9.

The developing means feeds a toner in a toner containing portion 9*c* by a rotatable first toner feeding member 9*i* which is feeding means, supplies the toner by a toner supplying roller 9R, rotates a developing sleeve 9S and forms on the surface of the developing sleeve 9S a toner layer having triboelectrification charges induced therein by a developing blade 9*h*, and shifts the toner to the photosensitive drum 2 in conformity with the electrostatic latent image to thereby form a toner image as a visible image.

The developing sleeve 9S supplies the toner to the photosensitive drum 2. Also, the developing blade 9*h* regulates the thickness of the toner layer adhering to the surface of the developing sleeve 9S. Also, the toner supplying roller 9R applies the toner to the developing sleeve 9S in such a manner that the outer peripheral surface thereof rubs against the surface of the developing sleeve 9S. The developing sleeve 9S and the toner supplying roller 9R are rotated so that their respective peripheral surfaces move in opposite directions in the rubbing portion.

A voltage opposite in polarity to the toner image is applied to a transfer roller 18 to thereby transfer the toner image to a transfer material 5, whereafter any toner residual on the photosensitive drum 2 is scraped off by a cleaning blade 12*a* and also is dipped by a dip sheet 12*b*, and the residual toner on the photosensitive drum 2 may be removed by cleaning means 12 for collecting the removed toner into the removed toner containing portion 12*c* of a cleaning container 11.

Cartridge Mounting Means

The members including the photosensitive drum 2 are contained and supported in a cartridge frame comprising a toner developing container 37 comprising a toner container 31 and a developing container 26 integrally welded together, and the cleaning container 11, the toner developing container 37 and the cleaning container 11 being coupled together, and are made into a cartridge and mounted on the main body of the apparatus A.

Cartridge mounting means is such that when an operable and closable member 35 is opened about a shaft 35*a* (see FIG. 9), a guide rail is provided in a downwardly bulged curved shape (in the present embodiment, a substantially arcuate shape) forwardly downwardly on each of left and right side surfaces in a cartridge mounting space, and the guide portions of the process cartridge B are inserted into the guide rails, and the guide portions are fitted into the positioning grooves of the guide rails to thereby effect the positioning of the process cartridge. As regards the guide portion, a positioning guide as a cylindrical projection is provided on the axis of the photosensitive drum 2 which is outward of the cartridge frame of the process cartridge, and a posture determining guide is provided near this positioning guide and on the upstream side with respect to the mounting direction of the process cartridge B (none of these is shown).

The close sealing construction of such a process cartridge B around the developing sleeve 9S and the toner supplying roller 9R is similar to that in First Embodiment, and the description of First Embodiment is invoked for the description thereof.

As is apparent from what has been described above, the present invention is applied to a partition member in which powder or liquid is present at one side and through which a rotary member extends from one side to the other side.

Applicable as such partition member is, for example, the container wall of a container in which a toner or a liquid developer is contained, or a partition member having the function as the container wall together with this container wall and mounted on the container wall, i.e., a filling member. This filling member is of a different shape in its outer periphery as already described, and this outer periphery fits in the cut-away recess of the container wall. This fitting includes a case where the outer periphery detachably fits and a case where the outer periphery is made undetachable through an adhesive agent.

As described above, it is not necessary to use an auxiliary seal or the like to effect the shaft sealing of that portion of the partition member through which the rotary member extends and therefore, the shaft sealing of the rotary member can be effected at a low cost and with a saved space. Accordingly, when this is applied to a developing device or a process cartridge, the size thereof can be made small.

What is claimed is:

1. A bushing used in a developer container, including a first rotary member and a second rotary member, to seal a developer from leaking out of the developer container, comprising:

an aperture portion through which the first rotary member extends, said aperture portion being provided with a seal portion contacting with a peripheral surface of the first rotary member for preventing the developer from leaking out of the developer container;

a fitting portion fitting in a recess formed in a frame of the developer container; and a concave portion, which is arc-shaped, provided along an outer periphery of the second rotary member, wherein said aperture portion, said seal portion, said fitting portion, and said concave portion are integrally formed as a unit.

2. A bushing according to claim 1, wherein said seal portion is lip-shaped and is provided along the peripheral surface of the first rotary member.

3. A bushing according to claim 1, wherein said bushing is an elastic member and wherein said seal portion is elastically urged against a peripheral surface of the first rotary member.

4. A bushing according to claim 1, wherein said bushing forms a portion of a wall of the frame by said fitting portion fitting in the recess.

5. A bushing according to claim 4, wherein said wall is a partition portion, which partitions a central portion and end portions of the first rotary member.

6. A bushing according to claim 4, wherein said bushing is detachably attachable to the frame.

7. A bushing according to claim 1, wherein the first rotary member extends through a portion of a space formed by the recess.

8. A bushing according to claim 1, wherein the first rotary member is provided, in a lengthwise direction thereof, with a conveying portion provided inwardly of said bushing for conveying the developer, and with a shaft portion extending through said aperture portion.

9. A bushing according to claim 8, wherein an inner diameter of said aperture portion is substantially the same as an outer diameter of the shaft portion.

10. A bushing according to claim 1, wherein each of the first and the second rotary members includes a roller.

11. A bushing according to claim 1, wherein said bushing is made of a rubber or resin material.

12. A bushing according to claim 1, further comprising a second fitting portion fitting in a second recess smaller than the recess and formed in the frame, said second fitting portion being formed integrally with said fitting portion and said seal portion.

13. A developing device comprising:

a developer container including a frame;

first and a second rotary members; and a bushing fitting in a recess formed in said frame, said bushing including:

an aperture portion through which said first rotary member extends, said aperture portion being provided with a seal portion contacting with a peripheral surface of said first rotary member for preventing the developer from leaking out of said developer container;

a fitting portion fitting in said recess formed in said frame; and a concave portion, which is arc-shaped, provided along an outer periphery of said second rotary member, wherein said aperture portion, said seal portion, said fitting portion, and said concave portion are integrally formed as a unit.

14. A developing device according to claim 13, wherein said seal portion is lip-shaped and is provided along a peripheral surface of said first rotary member.

15. A developing device according to claim 13, wherein said bushing is an elastic member, and said seal portion is elastically urged against a peripheral surface of said first rotary member.

16. A developing device according to claim 13, wherein said bushing forms a portion of a wall of the frame by said fitting portion fitting in said recess.

17. A developing device according to claim 16, wherein said wall is a partition portion, which partitions a central portion and end portions of said first rotary member.

18. A developing device according to claim 16, wherein said bushing is detachably attachable to the frame.

19. A developing device according to claim 13, wherein said first rotary member extends through a portion of a space formed by said recess.

20. A developing device according to claim 13, wherein said first rotary member is provided, in a lengthwise direction thereof, with a conveying portion provided inwardly of said bushing for conveying the developer, and with a shaft portion extending through said aperture portion.

21. A developing device according to claim 20, wherein an inner diameter of said aperture portion is substantially the same as an outer diameter of said shaft portion.

22. A developing device according to claim 13, wherein each of said first and second rotary members comprises a roller.

23. A developing device according to claim 13, wherein said bushing is made of a rubber or resin material.

24. A developing device according to claim 13, wherein said bushing is provided with a second fitting portion fitting in a second recess smaller than said recess and formed in said frame, said second fitting portion being formed integrally with said fitting portion and said seal portion.

25. A developing device according to claim 13, wherein said first rotary member supplies the developer to said second rotary member for supplying the developer to an image bearing member.

26. A developing device according to claim 13, wherein said developing device is provided, in a lengthwise direction of the frame, with an aperture in which said first rotary member fits at a side opposite to the side at which said recess of said frame is formed.

27. A developing device according to claim 13, wherein said developing device is detachably attachable to a main body of an image forming apparatus.

28. A developing device according to claim 13, wherein said developing device is provided in a process cartridge detachably attachable to a main body of an image forming apparatus together with an image bearing member.

* * * * *